US010518565B2

(12) United States Patent
Yamada et al.

(10) Patent No.: US 10,518,565 B2
(45) Date of Patent: Dec. 31, 2019

(54) LIQUID DISCHARGE APPARATUS, AND DRIVING CIRCUIT PROVIDED IN LIQUID DISCHARGE APPARATUS

(71) Applicant: Seiko Epson Corporation, Tokyo (JP)

(72) Inventors: Tomonori Yamada, Shiojiri (JP); Kazuhiro Nishiwake, Shiojiri (JP); Toru Matsuyama, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/140,926

(22) Filed: Sep. 25, 2018

(65) Prior Publication Data

US 2019/0092061 A1 Mar. 28, 2019

(30) Foreign Application Priority Data

Sep. 26, 2017 (JP) ..... 2017-184255

(51) Int. Cl.

| | |
|---|---|
| ***B41J 29/377*** | (2006.01) |
| ***B41J 2/045*** | (2006.01) |
| ***B41J 29/38*** | (2006.01) |

(52) U.S. Cl.

CPC ..... *B41J 29/377* (2013.01); *B41J 2/04541* (2013.01); *B41J 2/04563* (2013.01); *B41J 2/04581* (2013.01); *B41J 2/04593* (2013.01); *B41J 29/38* (2013.01)

(58) Field of Classification Search

CPC .... B41J 29/377; B41J 2/04541; B41J 2/1408; B41J 2/3358

See application file for complete search history.

(56) References Cited

U.S. PATENT DOCUMENTS

2012/0154489 A1* 6/2012 Nakayama ..... B41J 2/04515 347/57
2018/0272696 A1* 9/2018 Ito ..... B41J 2/04541

FOREIGN PATENT DOCUMENTS

JP 2000-294705 A 10/2000
JP 2001-144474 A 5/2001

* cited by examiner

*Primary Examiner* — Julian D Huffman

(74) *Attorney, Agent, or Firm* — Harness, Dickey & Pierce, P.L.C.

(57) ABSTRACT

A liquid discharge apparatus includes: a frame; a substrate that is fixed to the frame and has a first surface and a second surface; a first circuit that is provided on the first surface; a second circuit that is provided on the second surface; a heat conductive sheet; and a head unit that is driven by a driving signal and is capable of discharging liquid, in which the first circuit includes a driving signal generation circuit that generates the driving signal using a first transistor and a second transistor, the heat conductive sheet is in contact with the frame, the first surface, the first transistor, and the second transistor, and a distance between a portion of the first circuit farthest from the first surface and the first surface is shorter than a distance between a portion of the second circuit farthest from the second surface and the second surface.

9 Claims, 10 Drawing Sheets

| Sd[m] | Sd[m] SPECIFICATION CONTENTS | SL[m] | |
|---|---|---|---|
| | | Tu1 | Tu2 |
| (1, 1) | LARGE DOT | H | H |
| (1, 0) | MEDIUM DOT | H | L |
| (0, 1) | SMALL DOT | L | H |
| (0, 0) | NON-RECORDING | L | L |

LIQUID DISCHARGE APPARATUS, AND DRIVING CIRCUIT PROVIDED IN LIQUID DISCHARGE APPARATUS

This application claims priority to Japanese Patent Application No. 2017-184255 filed on Sep. 26, 2017. The entire disclosure of Japanese Patent Application No. 2017-184255 is hereby incorporated herein by reference.

BACKGROUND

1. Technical Field

The present invention relates to a liquid discharge apparatus, and a driving circuit provided in the liquid discharge apparatus.

2. Related Art

A liquid discharge apparatus such as an ink jet printer or the like forms an image on a recording medium by driving a head unit using a driving signal and causing the head unit to discharge liquid such as ink or the like.

In general, a driving signal for driving the head unit is a signal with large amplitude. Accordingly, a driving signal generation circuit that generates the driving signal generates heat when generating the driving signal. Therefore, the liquid discharge apparatus may be provided with a heat sink or a cooling fan for dissipating heat generated in the driving signal generation circuit in order to suppress a temperature rise in the driving signal generation circuit (for example, see JP-A-2000-294705 and JP-A-2001-144474).

Incidentally, size reduction of the liquid discharge apparatus has been advanced in recent years. However, providing the liquid discharge apparatus with the heat sink or the cooling fan causes difficulties in the size reduction of the liquid discharge apparatus in some cases.

SUMMARY

An advantage of some aspects of the invention is to provide a technique for facilitating size reduction of a liquid discharge apparatus, in comparison with an existing technique, when providing a heat dissipation mechanism for dissipating heat generated in a driving signal generation circuit.

A liquid discharge apparatus according to an aspect of the invention includes: a frame; a substrate that is fixed to the frame and has a first surface and a second surface; a first circuit that is provided on the first surface; a second circuit that is provided on the second surface; a heat conductive sheet; and a head unit that is driven by a driving signal and is capable of discharging liquid, in which the first circuit includes a driving signal generation circuit that generates the driving signal using a first transistor and a second transistor, the heat conductive sheet is in contact with the frame, the first surface, the first transistor, and the second transistor, and a distance between a portion of the first circuit farthest from the first surface and the first surface is shorter than a distance between a portion of the second circuit farthest from the second surface and the second surface.

According to this aspect, heat generated in the driving signal generation circuit that generates the driving signal using the first transistor and the second transistor can be dissipated to the frame through the heat conductive sheet. The heat conductive sheet is a sheet-shaped heat dissipation member. Therefore, a space to be secured for providing the heat conductive sheet is small. In order to improve heat dissipation efficiency, it is necessary to secure a sufficient surface area for a heat sink. Therefore, a space to be secured for providing the heat sink increases. A cooling fan includes a fan and a motor having sufficient sizes in order to supply a sufficient amount of air. Therefore, a space to be secured for providing the cooling fan increases. Thus, according to this aspect, since the heat generated in the driving signal generation circuit is dissipated through the heat conductive sheet, in comparison with a case of the heat dissipation using the heat sink or the cooling fan, the space to be secured for providing the heat dissipation mechanism can be reduced. Therefore, according to this aspect, the liquid discharge apparatus is reduced in size with ease.

Additionally, according to this aspect, a height of the first circuit including the driving signal generation circuit from the substrate is lower than a height of the second circuit from the substrate. Therefore, according to this aspect, in comparison with a case where the height of the first circuit from the substrate is higher than the height of the second circuit from the substrate, close adhesion between the first surface of the substrate and the heat conductive sheet can be enhanced. With this, according to this aspect, heat dissipation efficiency by the heat conductive sheet can be improved.

In the liquid discharge apparatus described above, it is preferable that the first circuit include a waveform specification circuit that generates a waveform specification signal configured to specify a waveform of the driving signal, and the first transistor and the second transistor generate the driving signal having a waveform specified by the waveform specification signal.

According to this aspect, on the first surface in which a temperature rise is suppressed by the heat dissipation through the heat conductive sheet, the waveform specification circuit is provided. Therefore, according to this aspect, a possibility of an erroneous operation being caused by the waveform specification circuit having a high temperature can be suppressed.

In the liquid discharge apparatus described above, it is preferable that the first transistor and the second transistor each be a bipolar transistor.

According to this aspect, in comparison with a case where a field effect transistor is employed as the first and second transistors, the driving signal having a waveform accurately reproducing a desired waveform can be generated. Therefore, according to this aspect, it is possible to accurately control the head unit and to execute printing with high quality.

In the liquid discharge apparatus described above, it is preferable that the second circuit include a power source circuit that supplies a power source to the driving signal generation circuit, and the power source circuit include a smoothing capacitor to which an AC voltage is inputted and that smooths the AC voltage.

According to this aspect, since the smoothing capacitor whose height from the substrate is high is provided on the second surface, in comparison with a case where the smoothing capacitor is provided on the first surface, the close adhesion between the heat conductive sheet and the first surface of the substrate can be enhanced. Therefore, according to this aspect, the heat generated in the driving signal generation circuit can be efficiently dissipated.

In the liquid discharge apparatus described above, it is preferable that a thickness of the heat conductive sheet be no less than the distance between the portion of the first circuit farthest from the first surface and the first surface.

According to this aspect, since the heat conductive sheet has the thickness that is no less than the height of the first circuit from the substrate, in comparison with a case where the thickness of the heat conductive sheet is less than the height of the first circuit from the substrate, the close adhesion between the heat conductive sheet and the first surface of the substrate can be enhanced. Therefore, according to this aspect, the heat generated in the driving signal generation circuit can be efficiently dissipated.

In the liquid discharge apparatus described above, it is preferable that the heat conductive sheet have elasticity.

According to this aspect, since the heat conductive sheet has the elasticity, in comparison with a case where the heat conductive sheet does not have the elasticity, a degree of freedom in arrangement of the heat conductive sheet can be enhanced. Therefore, according to this aspect, the space to be secured for providing the heat conductive sheet can be reduced, and the liquid discharge apparatus is reduced in size with ease.

It is preferable that the liquid discharge apparatus described above include a screw for fixing the substrate to the frame, and the heat conductive sheet be fixed to the frame with the screw.

According to this aspect, since the screw for fixing the substrate to the frame and the screw for fixing the heat conductive sheet to the frame are the same, in comparison with a case where a screw for fixing the substrate to the frame and a screw for fixing the heat conductive sheet to the frame are different from each other, close adhesion of the heat conductive sheet with respect to the frame and close adhesion of the heat conductive sheet with respect to the substrate can be enhanced. Therefore, according to this aspect, the heat generated in the driving signal generation circuit can be efficiently dissipated.

In the liquid discharge apparatus described above, it is preferable that the head unit include 720 or more discharge sections, and the discharge sections be driven by the driving signal and capable of discharging the liquid.

According to this aspect, printing of a high-resolution image can be performed.

Additionally, a driving circuit according to an aspect of the invention is a driving circuit provided in a liquid discharge apparatus that includes: a frame; a substrate that is fixed to the frame and has a first surface and a second surface; a heat conductive sheet; and a head unit that is driven by a driving signal and is capable of discharging liquid, the driving circuit includes: a first circuit that is provided on the first surface; and a second circuit that is provided on the second surface, in which the first circuit includes a driving signal generation circuit that generates the driving signal using a first transistor and a second transistor, the heat conductive sheet is in contact with the frame, the first surface, the first transistor, and the second transistor, and a distance between a portion of the first circuit farthest from the first surface and the first surface is shorter than a distance between a portion of the second circuit farthest from the second surface and the second surface.

According to this aspect, since heat generated in the driving signal generation circuit is dissipated through the heat conductive sheet, in comparison with a case of heat dissipation using the heat sink or the cooling fan, the space to be secured for providing the heat dissipation mechanism can be reduced. Therefore, according to this aspect, the liquid discharge apparatus is reduced in size with ease.

Additionally, according to this aspect, a height of the first circuit including the driving signal generation circuit from the substrate is lower than a height of the second circuit from the substrate. Therefore, according to this aspect, in comparison with a case where the height of the first circuit from the substrate is higher than the height of the second circuit from the substrate, close adhesion between the first surface of the substrate and the heat conductive sheet can be enhanced. With this, according to this aspect, heat dissipation efficiency by the heat conductive sheet can be improved.

In the liquid discharge apparatus described above, it is preferable that the first circuit include a thermistor for detection of a temperature.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings. It should be noted that, in each of the drawings, dimensions and scales of respective portions are made appropriately different from actual dimensions and scales. Additionally, although, since the embodiment described below is a preferable specific example of the invention, various technically preferable limitations are added thereto, the scope of the invention is not limited to these embodiments unless there is particular description for limiting the invention in the following descriptions.

A. Embodiment

In the embodiment, by exemplifying an ink jet printer that discharges ink (an example of "liquid") and forms an image on recording paper P (an example of "medium"), a liquid discharge apparatus will be described.

1. Overview of Ink Jet Printer

Hereinafter, referring to FIG. 1 and FIG. 2, a configuration of an ink jet printer 1 according to the embodiment will be described.

Figure 1:
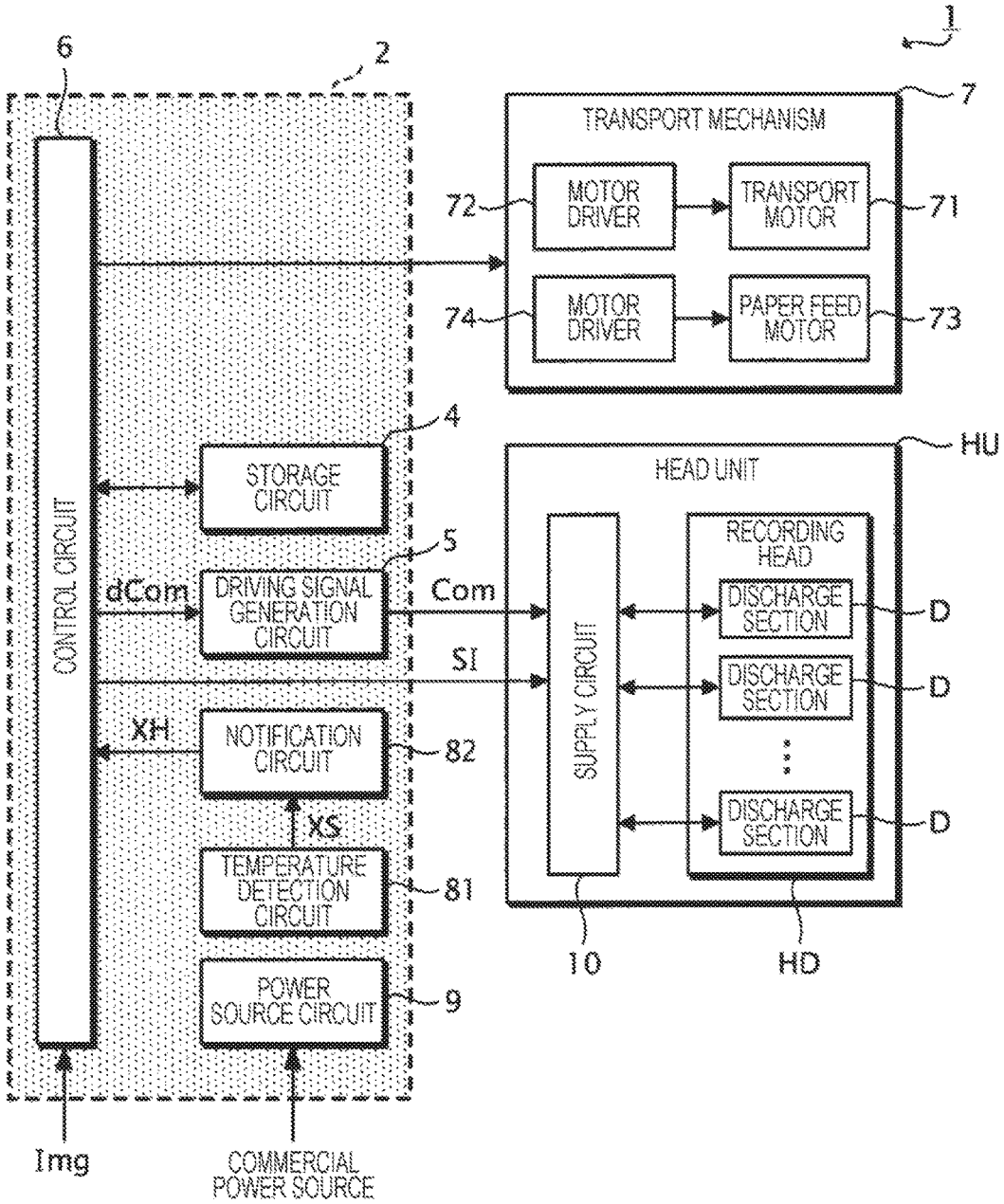
FIG. 1 is a block diagram illustrating an example of a configuration of an ink jet printer according to the invention.

FIG. 1 is a functional block diagram illustrating an example of the configuration of the ink jet printer 1. The ink jet printer 1 is supplied with printing data Img that indicate an image to be formed by the ink jet printer 1 from a host computer (not illustrated) such as a personal computer, a digital camera, or the like. The ink jet printer 1 executes printing processing for forming the image indicated by the printing data Img supplied from the host computer on the recording paper P.

As exemplified in FIG. 1, the ink jet printer 1 includes a control module 2, a head unit HU in which a discharge section D that discharges the ink is provided, and a transport mechanism 7 for changing a relative position of the recording paper P with respect to the head unit HU. Of these, the control module 2 includes a control circuit 6 that controls an operation of each portion of the ink jet printer 1, a driving signal generation circuit 5 that generates a driving signal Com for driving the discharge section D, a storage circuit 4 that stores various kinds of information, a power source circuit 9 that supplies electric power to each portion of the ink jet printer 1, a temperature detection circuit 81, and a notification circuit 82. Note that, in the embodiment, as an example, a case where each constituent element of the control module 2 (control circuit 6, driving signal generation circuit 5, storage circuit 4, power source circuit 9, temperature detection circuit 81, and notification circuit 82) is formed on a substrate 200 (see FIG. 2) is assumed.

The temperature detection circuit 81 includes a thermistor TM that detects a temperature of the ink jet printer 1 (see FIG. 7), and outputs a detection signal XS indicating a detection result by the thermistor TM.

The notification circuit 82 outputs a notification signal XH indicating whether or not the temperature indicated by the detection signal XS is no less than a predetermined temperature. For example, the notification circuit 82 may be a circuit that compares an electric signal such as a current value, a voltage value, or the like, outputted from the thermistor TM and another reference electric signal with each other, and changes output in accordance with a magnitude relationship between values indicated by the two electric signals. For example, as the notification circuit 82, a comparator can be employed.

The head unit HU includes a recording head HD including 4M pieces of the discharge sections D, and a supply circuit 10 that switches whether or not the driving signal Com outputted by the driving signal generation circuit 5 is supplied to the recording head HD (in the embodiment, M is a natural number that satisfies $1 \leq M$).

Hereinafter, the 4M discharge sections D provided in the recording head HD may be referred to as a first stage, a second stage, . . . , and a 4M stage, respectively, in order to distinguish each one from others. Additionally, the discharge section D of an m stage may be referred to as a discharge section D[m] (the variable m is a natural number that satisfies $1 \leq m \leq 4M$). Additionally, in a case where the constituent element, the signal, or the like of the ink jet printer 1 corresponds to the stage number m of the discharge section D[m], a sign for expressing the constituent element, the signal, or the like may be expressed by adding an index [m] indicating that it corresponds to the stage number m.

Additionally, in the following, among the driving signals Com, the driving signal Com supplied to the discharge section D may be referred to as a supply driving signal Vin. Additionally, the supply driving signal Vin supplied to the discharge section D[m] may be referred to as a supply driving signal Vin[m].

The storage circuit 4 is, for example, configured by including one or both of a volatile memory such as a RAM (Random Access Memory) or the like and a nonvolatile memory such as a ROM (Read Only Memory), an EEPROM (Electrically Erasable Programmable Read-Only Memory), a PROM (Programmable ROM), or the like, and stores the printing data Img supplied from the host computer and various kinds of information such as a control program of the ink jet printer 1 or the like.

The control circuit 6 is configured by including a CPU (Central Processing Unit). Note that, the control circuit 6 may include a programmable logic device such as an FPGA (field-programmable gate array) or the like instead of the CPU or in addition to the CPU.

The control circuit 6 controls the operation of each portion of the ink jet printer 1 by the CPU provided in the control circuit 6 executing the control program stored in the storage circuit 4 and operating in accordance with the control program. To be specific, the control circuit 6 generates signals for controlling the operation of each portion of the ink jet printer 1, such as a printing signal SI for controlling the supply circuit 10 provided in the head unit HU, a waveform specification signal dCom for controlling the driving signal generation circuit 5, a signal for controlling the transport mechanism 7, and the like.

Here, the waveform specification signal dCom is a digital signal for specifying a waveform of the driving signal Com. In other words, the control circuit 6 is an example of a "waveform specification circuit" that generates the waveform specification signal dCom for specifying the waveform of the driving signal Com.

Additionally, the driving signal Com is an analog signal for driving the discharge section D. The driving signal generation circuit 5 generates the driving signal Com having a waveform defined by the digital waveform specification signal dCom.

Additionally, the printing signal SI is a digital signal for specifying a type of an operation of the discharge section D. To be specific, the printing signal SI specifies the type of the operation of the discharge section D by specifying whether or not the driving signal Com is supplied to the discharge section D. Here, the specification of the type of the operation of the discharge section D is, for example, to specify whether or not to drive the discharge section D, to specify whether or not to discharge the ink from the discharge section D when driving the discharge section D, or to specify an ink amount discharged from the discharge section D when driving the discharge section D.

In a case where the printing processing is executed, first, the control circuit 6 causes the storage circuit 4 to store the printing data Img supplied from the host computer. Next, the control circuit 6 generates various kinds of control signals such as the printing signal SI, the waveform specification signal dCom, the signal for controlling the transport mechanism 7, and the like on the basis of various kinds of data such as the printing data Img or the like, stored in the storage circuit 4. Then, the control circuit controls the supply circuit 10 such that the discharge section D is driven while controlling the transport mechanism 7 so as to change the relative position of the recording paper P with respect to the head unit HU on the basis of the various kinds of control signals such as the printing signal SI or the like and the various kinds of data stored in the storage circuit 4. With this, the control circuit 6 adjusts the presence or absence of the ink discharged from the discharge section D, the ink discharge amount, an ink discharge timing, or the like, and controls each portion of the ink jet printer 1 such that the printing processing for forming the image corresponding to the printing data Img on the recording paper P is executed.

Figure 2:
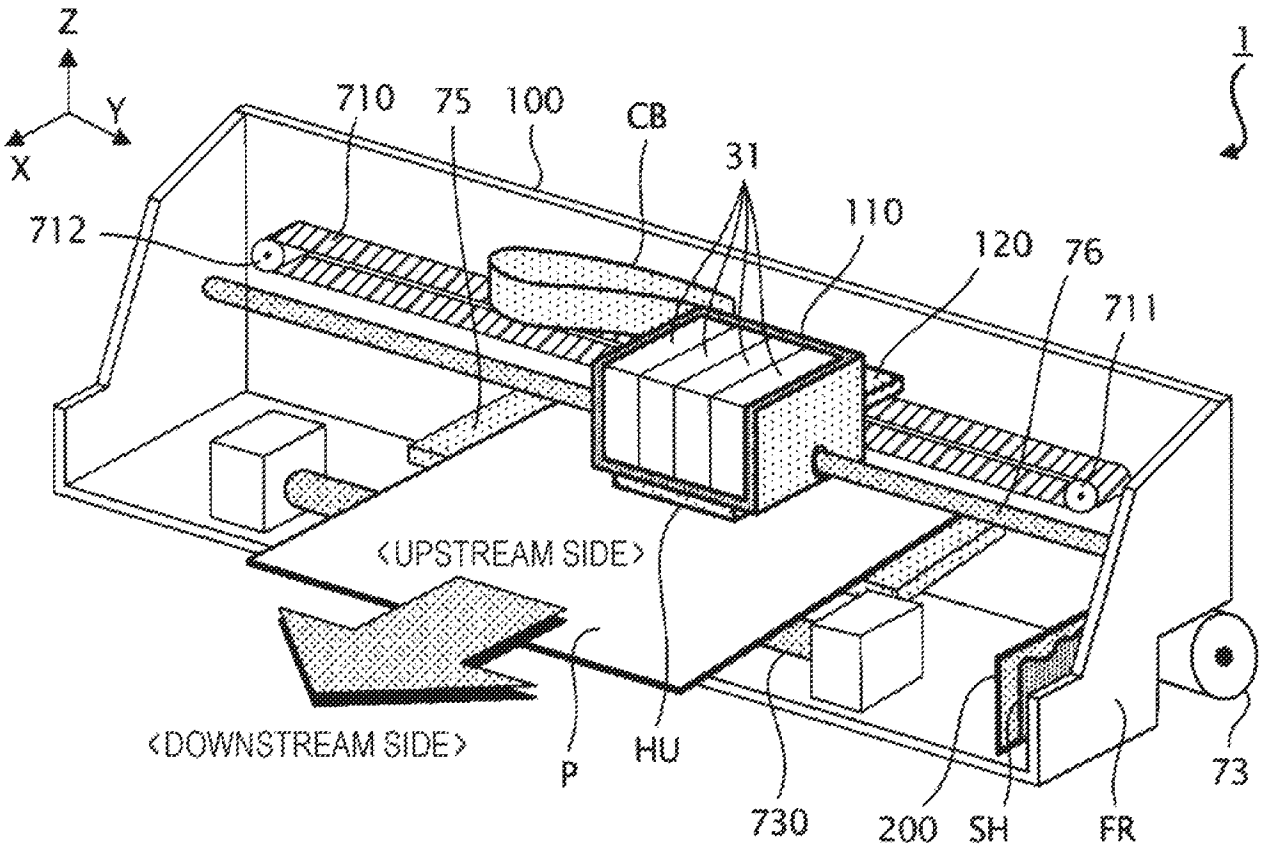
FIG. 2 is a perspective view illustrating an example of a schematic internal structure of the ink jet printer.

FIG. 2 is a perspective view illustrating an example of a schematic internal structure of the ink jet printer 1. As illustrated in FIG. 2, in the embodiment, a case where the ink jet printer 1 is a serial printer is assumed. Specifically, in a case of executing the printing processing, the ink jet printer 1 forms dots based on the printing data Img on the recording paper P, while transporting the recording paper P in a sub scanning direction, by causing the discharge section D to discharge the ink while causing the head unit HU to reciprocate in a main scanning direction intersecting with the sub scanning direction.

Hereinafter, a +X direction and a −X direction being a reverse direction thereof are collectively referred to as an "X-axis direction", a +Y direction and a −Y direction being a reverse direction thereof are collectively referred to as a "Y-axis direction", and a +Z direction and a −Z direction being a reverse direction thereof are collectively referred to as a "Z-axis direction". In the embodiment, as illustrated in FIG. 2, a direction from a −X side (upstream side) toward a +X side (downstream side) is taken as the sub scanning direction, and the Y-axis direction is taken as the main scanning direction. Note that, in the embodiment, although a case where the X-axis direction, the Y-axis direction, and the Z-axis direction are directions that are orthogonal to one another is assumed as an example, the X-axis direction, the Y-axis direction, and the Z-axis direction may be directions that intersect with one another.

As exemplified in FIG. 2, the ink jet printer 1 according to the embodiment includes a housing 100 at least a part of which is formed of a metal-made member, a metal member provided inside the housing 100 and fixed to the housing 100, and a carriage 110 capable of reciprocating in the Y-axis direction in the housing 100 and on which the head unit HU is mounted. Note that, in the following descriptions, of the housing 100, a portion formed of the metal-made member and the metal member fixed to the housing 100 may be collectively referred to as a "frame FR".

As exemplified in FIG. 2, the ink jet printer 1 according to the embodiment includes the substrate 200 on which constituent elements of the control module 2 are each formed and a heat conductive sheet SH provided so as to make contact with the substrate 200 and the frame FR.

In the embodiment, for the convenience of description, as illustrated in FIG. 2, a case where the substrate 200 is provided such that a straight line perpendicular to the substrate 200 and the Y-axis direction are parallel to each other and the substrate 200 is parallel to an XZ plane is assumed as an example.

In the embodiment, a case where the heat conductive sheet SH is a flat sheet-shaped member having a heat conductivity and having an elasticity is assumed. Additionally, in the embodiment, as illustrated in FIG. 2, a case where a part or all of the heat conductive sheet SH is provided between the substrate 200 and the frame FR is assumed as an example. The heat conductive sheet SH is a constituent element for dissipating heat generated in the control module 2 to the frame FR.

Additionally, as described above, the ink jet printer 1 according to the embodiment includes the transport mechanism 7.

When the printing processing is executed, the transport mechanism 7 changes, by causing the carriage 110 to reciprocate in the Y-axis direction and transporting the recording paper P in the +X direction, the relative position of the recording paper P with respect to the head unit HU, and enables ink landing with respect to the entire recording paper P. The transport mechanism 7 includes, as illustrated in FIG. 1, a transport motor 71 to be a driving source for causing the carriage 110 to reciprocate, a motor driver 72 for driving the transport motor 71, a paper feed motor 73 to be a driving source for transporting the recording paper P, and a motor driver 74 for driving the paper feed motor 73. Additionally, the transport mechanism 7 includes, as illustrated in FIG. 2, a carriage guide shaft 76 extending in the Y-axis direction and a timing belt 710 that is stretched between a pulley 711, which is rotationally driven by the transport motor 71, and a freely rotatable pulley 712 and extends in the Y-axis direction. The carriage 110 is supported by the carriage guide shaft 76 in a freely reciprocating manner in the Y-axis direction, and fixed to a predetermined position of the timing belt 710 with a fixing tool 120 interposed therebetween. Therefore, by rotationally driving the pulley 711 by the transport motor 71, the transport mechanism 7 can cause the carriage 110 to reciprocate with the head unit HU in the Y-axis direction along the carriage guide shaft 76.

Additionally, as illustrated in FIG. 2, the transport mechanism 7 includes a platen 75 provided on a lower side (−Z side) of the carriage 110, a paper feed roller (not illustrated) for supplying the recording paper P one by one onto the platen 75 by rotating in accordance with driving of the paper feed motor 73, and a paper discharge roller 730 for transporting the recording paper P on the platen 75 to a paper discharge port by rotating in accordance with the driving of the paper feed motor 73. Therefore, as illustrated in FIG. 2, the transport mechanism 7 can transport the recording paper P on the platen 75 from the −X side (upstream side) toward the +X side (downstream side).

In the embodiment, as exemplified in FIG. 2, in the carriage 110 of the ink jet printer 1, four ink cartridges are mounted. More specifically, in the embodiment, a case where the four ink cartridges 31 corresponding to four-color inks (CMYK) of cyan, magenta, yellow, and black on one-to-one basis are mounted in the carriage 110 is assumed an example.

Additionally, in the embodiment, a case where the 4M discharge sections D are divided into four groups corresponding to the four ink cartridges 31 on one-to-one basis is assumed as an example. Additionally, each of the discharge sections D is supplied with the ink from the ink cartridge 31 corresponding to the group to which the discharge section D belongs. With this, the inside of each of the discharge sections D is filled with the supplied ink, and the ink with which the inside is filled can be discharged through a nozzle N (see FIG. 3). In other words, a total of 4M discharge sections D included in the head unit HU can discharge the four-color inks of CMYK as a whole.

Note that, in the embodiment, a case where the M discharge sections D belong to each of the groups is assumed as an example.

Additionally, FIG. 2 is merely an example, and the ink cartridge 31 may be provided outside the carriage 110.

2. Overview of Recording Head and Discharge Section

Figure 3:
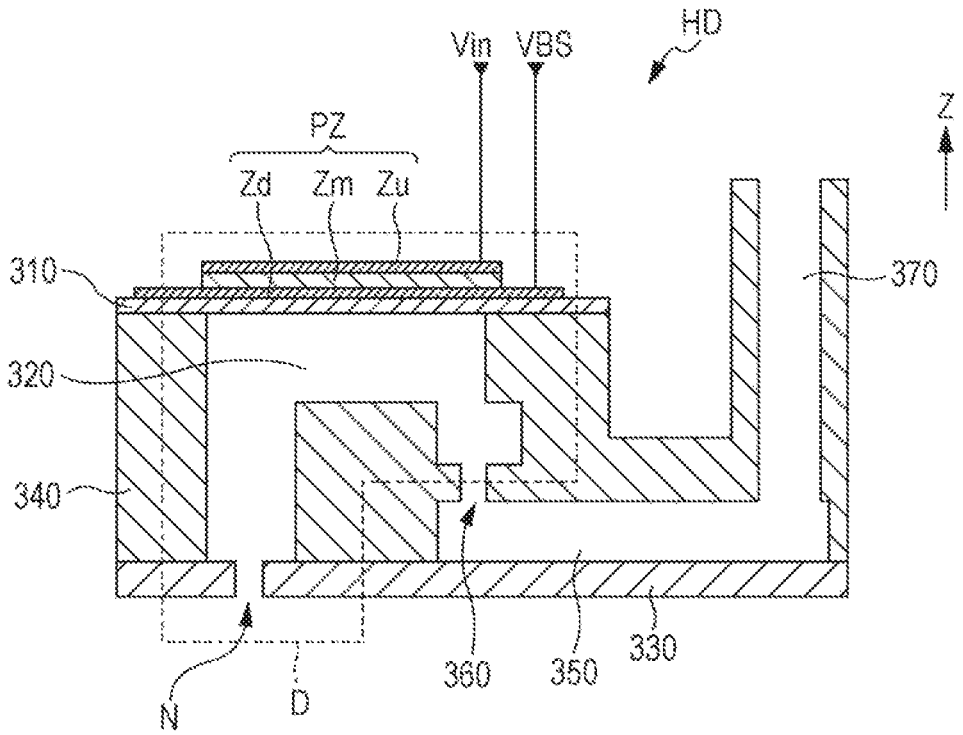
FIG. 3 is a descriptive diagram for explaining an example of a structure of a discharge section.
Figure 4:
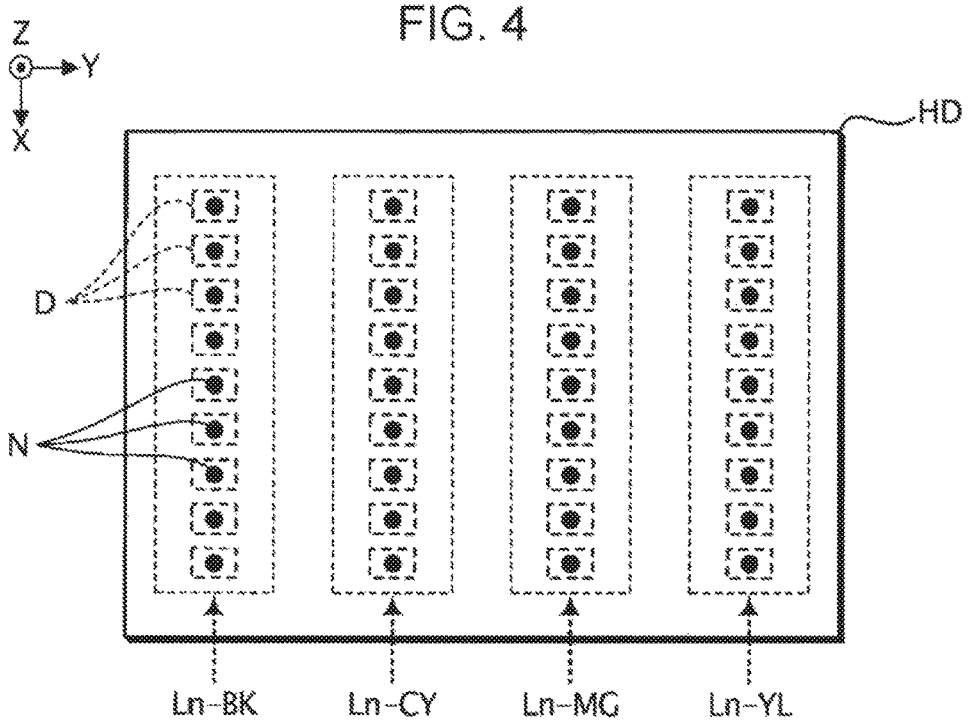
FIG. 4 is a plan view illustrating an example of a nozzle arrangement of a recording head.

Referring to FIG. 3 and FIG. 4, the recording head HD and the discharge section D provided in the recording head HD will be described.

FIG. 3 is a schematic and partial cross-sectional view of the recording head HD obtained by cutting the recording head HD so as to include the discharge section D.

As illustrated in FIG. 3, the discharge section D includes a piezoelectric element PZ, a cavity 320 whose inside is filled with the ink, the nozzle N communicating with the cavity 320, and a vibration plate 310. By the piezoelectric element PZ being supplied with the supply driving signal Vin and the piezoelectric element PZ being driven by the supply driving signal Vin, the discharge section D discharges the ink in the cavity 320 through the nozzle N. The cavity 320 is a space defined by a cavity plate 340, a nozzle plate 330 in which the nozzle N is formed, and the vibration plate 310. The cavity 320 communicates with a reservoir 350 through an ink supply port 360. The reservoir 350 communicates with the ink cartridge 31 corresponding to the discharge section D through an ink intake port 370.

In the embodiment, as the piezoelectric element PZ, a unimorph-type (monomorph-type) element as illustrated in FIG. 3 is employed. Note that, the piezoelectric element PZ is not limited to the unimorph-type element, a bimorph-type element, a multilayer-type element, or the like may be employed.

The piezoelectric element PZ includes an upper electrode Zu, a lower electrode Zd, and a piezoelectric body Zm provided between the upper electrode Zu and the lower electrode Zd. The lower electrode Zd is electrically connected to a power feed line LHd (see FIG. 11) that is set to a power source potential VBS on a low potential side. Then, when the upper electrode Zu is supplied with the driving signal Com (supply driving signal Vin) and a voltage is applied between the upper electrode Zu and the lower electrode Zd, the piezoelectric element PZ is displaced in the +Z direction or the −Z direction in accordance with the applied voltage, and the piezoelectric element PZ vibrates as a result.

On an upper surface opening portion of the cavity plate 340, the vibration plate 310 is installed. The lower electrode Zd is bonded to the vibration plate 310. Therefore, when the piezoelectric element PZ is driven by the supply driving signal Vin and displaced, the vibration plate 310 is also displaced. Then, a volume of the cavity 320 changes by the displacement of the vibration plate 310, and the ink with which the inside of the cavity 320 is filled is discharged through the nozzle N.

FIG. 4 is a descriptive diagram for explaining an example of an arrangement of the 4M nozzles N provided in the recording head HD when the ink jet printer 1 is viewed in a plan view from the +Z direction or the −Z direction.

As illustrated in FIG. 4, the recording head HD is provided with four nozzle rows Ln. Here, the nozzle row Ln includes the plurality of nozzles N provided so as to extend in a predetermined direction in a row shape. In the embodiment, a case where each of the nozzle rows Ln is configured such that the M nozzles N are arranged so as to extend in the X-axis direction in a row shape is assumed.

Hereinafter, the four nozzle rows Ln provided in the recording head HD are referred to as nozzle rows Ln-BK, Ln-CY, Ln-MG, and Ln-YL, respectively. Here, the nozzle row Ln-BK is the nozzle row Ln in which the nozzles N of the discharge section D that discharges a black ink are arrayed, the nozzle row Ln-CY is the nozzle row Ln in which the nozzles N of the discharge section D that discharges a cyan ink are arrayed, the nozzle row Ln-MG is the nozzle row Ln in which the nozzles N of the discharge section D that discharges a magenta ink are arrayed, and the nozzle row Ln-YL is the nozzle row Ln in which the nozzles N of the discharge section D that discharges a yellow ink are arrayed.

Note that, the nozzle rows Ln illustrated in FIG. 4 are an example, the M nozzles N belonging to each of the nozzle rows Ln may be arranged in a direction intersecting with the direction in which the nozzle row Ln extends with a predetermined width. In other words, in each of the nozzle rows Ln, the plurality of nozzles N belonging to each of the nozzle rows Ln may be arranged in a staggered shape such that positions of an even-numbered nozzle N and an odd-numbered nozzle N from the +X side in the Y-axis direction differ from each other. Additionally, each of the nozzle rows Ln may extend in a different direction from the X-axis direction. Additionally, in the embodiment, although a case where the number of the rows of the nozzle rows Ln provided in the recording head HD is "4" is described as an example, the recording head HD may be provided with one or more nozzle rows Ln.

3. Overview of Driving Signal Generation Circuit

Next, referring to FIG. 5, the driving signal generation circuit 5 will be described.

Figure 5:
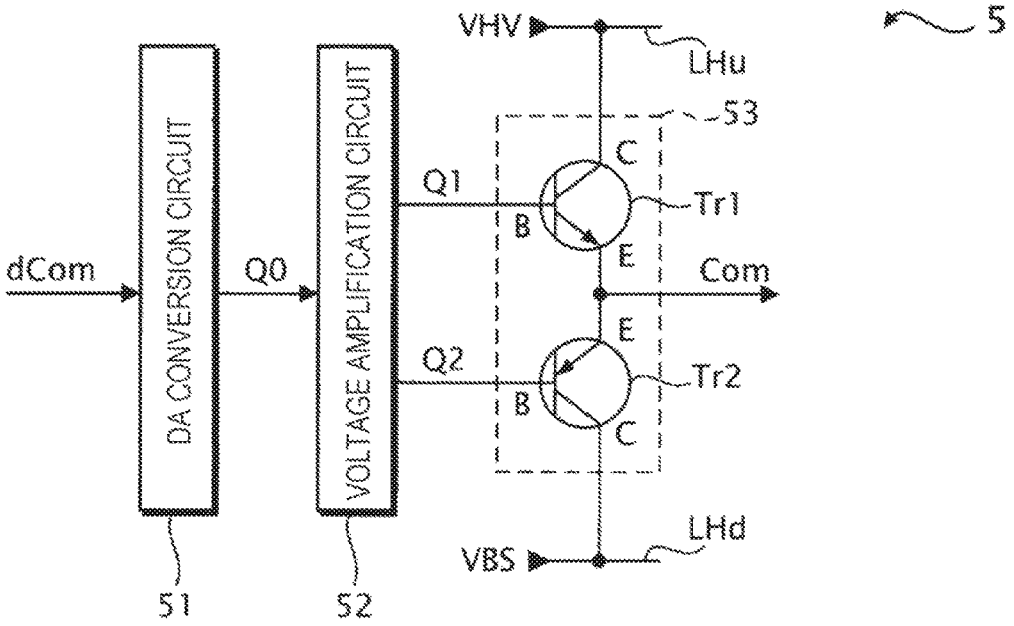
FIG. 5 is a block diagram illustrating an example of a configuration of a driving signal generation circuit.

FIG. 5 is a block diagram illustrating a configuration of the driving signal generation circuit 5.

As illustrated in FIG. 5, the driving signal generation circuit 5 includes a DA conversion circuit 51, a voltage amplification circuit 52, and a current amplification circuit 53.

The DA conversion circuit 51 outputs a signal Q0 that defines a waveform of the driving signal Com on the basis of the waveform specification signal dCom.

The voltage amplification circuit 52 outputs a signal Q1 and a signal Q2 on the basis of the signal Q0. Specifically, the voltage amplification circuit 52 outputs, for example, by amplifying a voltage between a potential to be a reference such as the power source potential VBS on the low potential side or the like and the signal Q0, the signal Q1 and the signal Q2 indicating a potential based on a potential of the driving signal Com.

The current amplification circuit 53 is a so-called push-pull circuit including a transistor Tr1 (an example of a "first transistor") and a transistor Tr2 (an example of a "second transistor").

Specifically, the transistor Tr1 is, for example, an NPN-type bipolar transistor, in which a base (B) is supplied with the signal Q1, a collector (C) is electrically connected to a power feed line LHu that supplies a power source potential VHV on a high potential side, and an emitter (E) is electrically connected to a wiring LHa for supplying the driving signal Com.

Additionally, the transistor Tr2 is, for example, an PNP-type bipolar transistor, in which the base (B) is supplied with the signal Q2, the collector (C) is electrically connected to the power feed line LHd that supplies the power source potential VBS on the low potential side, and the emitter (E) is electrically connected to the wiring LHa for supplying the driving signal Com.

The current amplification circuit 53 generates the driving signal Com on the basis of the signal Q1 and the signal Q2.

Specifically, the transistor Tr1 of the current amplification circuit 53 turns on in a case where the potential of the signal Q1 increases, and increases the potential of the driving signal Com as a result. Note that, the transistor Tr1 turns off in a case where the potential of the signal Q1 is constant and in a case where the potential of the signal Q1 decreases.

On the other hand, the transistor Tr2 of the current amplification circuit 53 turns on in a case where the potential of the signal Q2 decreases, and decreases the potential of the driving signal Com as a result. Note that, the transistor Tr2 turns off in a case where the potential of the signal Q2 is constant and in a case where the potential of the signal Q2 increases.

4. Overview of Power Source Circuit

Next, referring to FIG. 6, the power source circuit 9 will be described.

Figure 6:
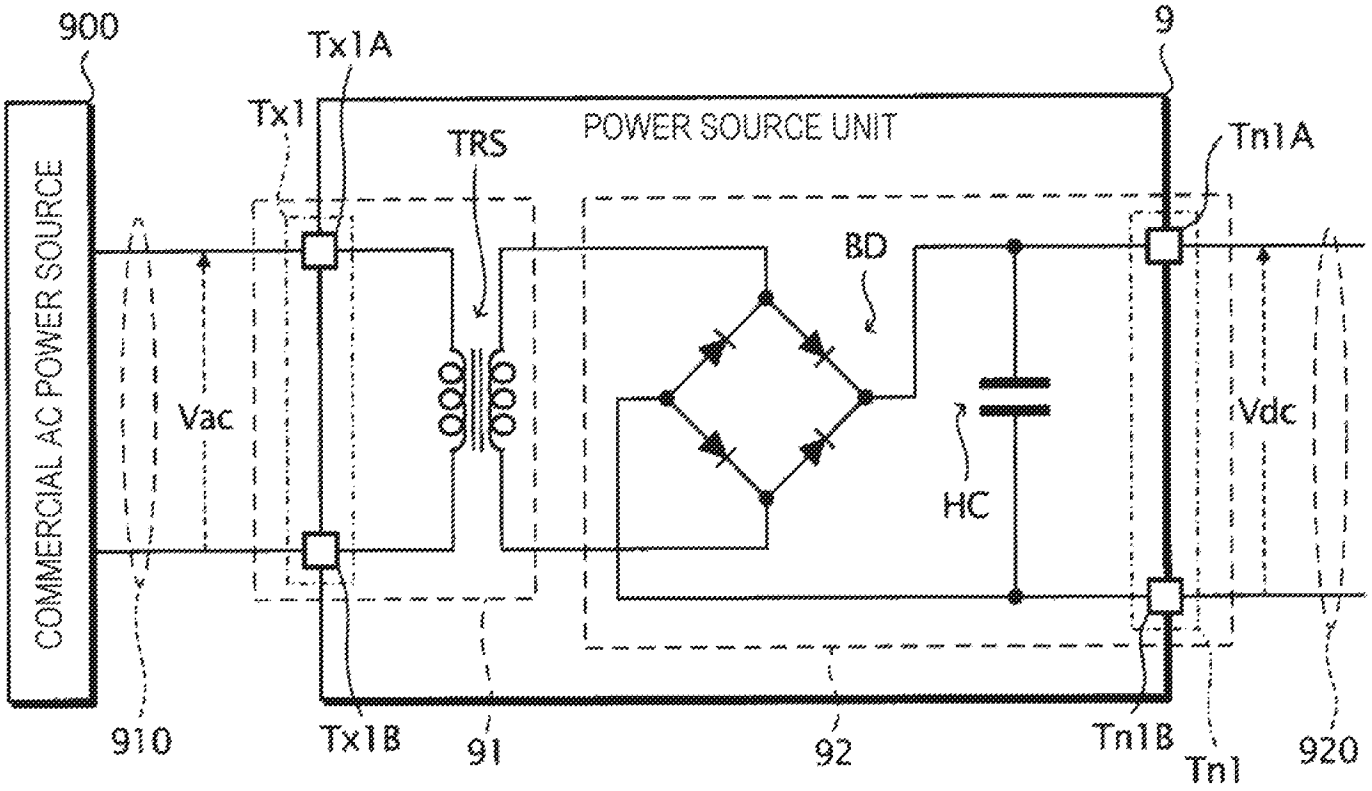
FIG. 6 is a block diagram illustrating an example of a configuration of a power source circuit.

FIG. 6 is a circuit diagram illustrating an example of a schematic configuration of the power source circuit 9.

As illustrated in FIG. 6, the power source circuit 9 includes a voltage conversion circuit 91 and a smoothing circuit 92.

The voltage conversion circuit 91 transforms an AC voltage supplied from a commercial AC power source 900, and outputs the transformed AC voltage to the smoothing circuit 92. Specifically, the voltage conversion circuit 91 includes an input terminal Tx1 and a transformer TRS. Of these, the input terminal Tx1 includes a terminal Tx1A and a terminal Tx1B that can be electrically connected to a power source cable 910. Then, an AC voltage Vac is inputted to the input terminal Tx1 from the commercial AC power source 900 through the power source cable 910. Additionally, the transformer TRS transforms the AC voltage Vac inputted to the input terminal Tx1, and outputs the transformed AC voltage to the smoothing circuit 92.

The smoothing circuit 92 smooths the AC voltage outputted from the voltage conversion circuit 91 and converts it to a DC voltage. Specifically, the smoothing circuit 92 includes a rectifying circuit BD, a smoothing capacitor HC, and an output terminal Tn1. Of these, the rectifying circuit BD is, for example, a bridge diode that is configured by including a plurality of diodes, and rectifies the AC voltage inputted from the voltage conversion circuit 91. Additionally, the smoothing capacitor HC smooths the rectified voltage by the voltage conversion circuit 91 and converts it to a DC voltage Vdc, and supplies the DC voltage Vdc to the output terminal Tn1. The output terminal Tn1 includes a terminal Tn1A and a terminal Tn1B connected to an internal power source wiring 920. The terminal Tn1B is set to the power source potential VBS on the low potential side, and electrically connected to the power feed line LHd. The terminal Tn1A is set to the power source potential VHV on the high potential side with a higher potential than the power source potential VBS by a potential Vdc, and electrically connected to the power feed line LHu.

5. Substrate and Heat Conductive Sheet

Next, referring to FIG. 7 to FIG. 10, a circuit arrangement on the substrate 200 and a positional relationship between the substrate 200 and the heat conductive sheet SH will be described.

Figure 7:
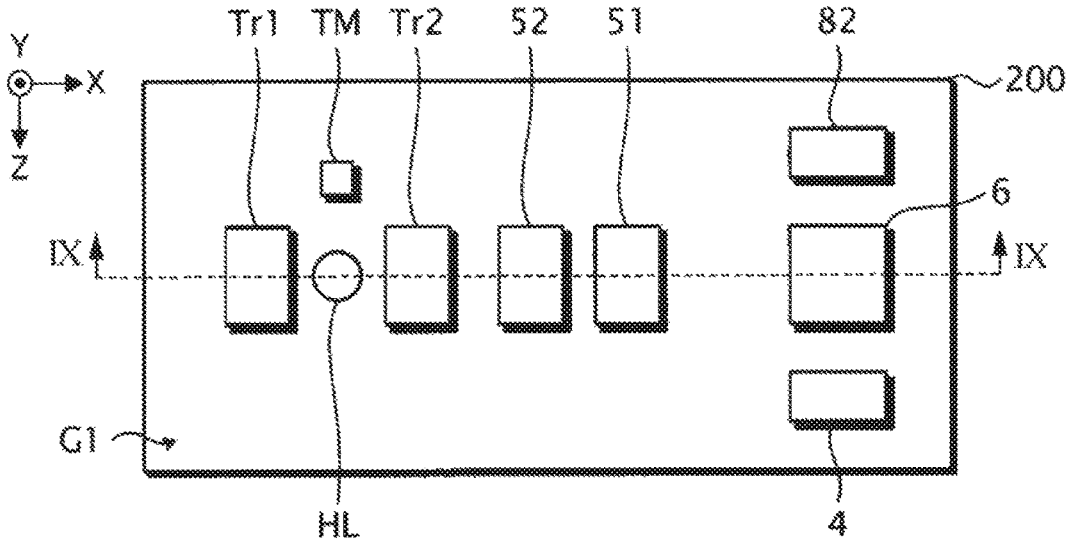
FIG. 7 is a plan view illustrating an example of a circuit arrangement on a substrate.
Figure 8:
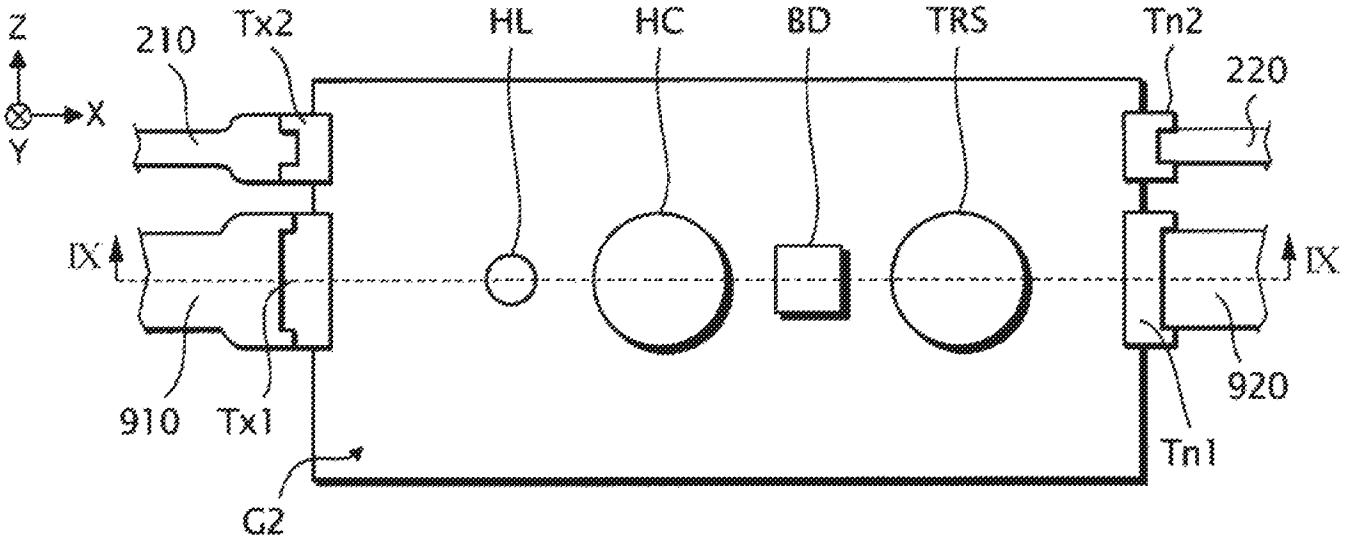
FIG. 8 is a plan view illustrating an example of a circuit arrangement on the substrate.

FIG. 7 is an example of a plan view of the substrate 200 when the substrate 200 is viewed in a plan view from the +Y side. Additionally, FIG. 8 is an example of a plan view of the substrate 200 when the substrate 200 is viewed in a plan view from the −Y side. In the embodiment, as illustrated in FIG. 2, a case where the heat conductive sheet SH is provided between the substrate 200 and the frame FR positioned in the +Y direction of the substrate 200 is assumed. In other words, FIG. 7 is a diagram illustrating an example of a surface of the substrate 200 on a heat conductive sheet SH side (hereinafter, referred to as a "surface G1"), and FIG. 8 is a diagram illustrating an example of a surface of the substrate 200 on an opposite side from the heat conductive sheet SH (hereinafter, referred to as a "surface G2"). Note that, the surface G1 of the substrate 200 on the heat conductive sheet SH side is an example of a "first surface", and the surface G2 of the substrate 200 on the opposite side from the heat conductive sheet SH is an example of a "second surface".

In the embodiment, as exemplified in FIG. 7, a case where, on the surface G1 of the substrate 200, the driving signal generation circuit 5 including the transistor Tr1, the transistor Tr2, the DA conversion circuit 51, and the voltage amplification circuit 52, the temperature detection circuit 81 including the thermistor TM, the notification circuit 82, the control circuit 6, and the storage circuit 4 are provided is assumed. However, the invention is not limited to such an aspect, it is sufficient for the surface G1 of the substrate 200 to be provided with at least the driving signal generation circuit 5. Note that, in the following descriptions, a circuit provided on the surface G1 of the substrate 200 may be referred to as a "first circuit".

In the embodiment, as exemplified in FIG. 8, a case where, on the surface G2 of the substrate 200, the power source circuit 9 including the smoothing capacitor HC, the rectifying circuit BD, and the transformer TRS, the input terminal Tx1, an input terminal Tx2, the output terminal Tn1, and an output terminal Tn2 are provided is assumed. Here, the input terminal Tx2 is a terminal for connecting to an exterior wiring 210 such as a USB (Universal Serial Bus) cable, a LAN (Local Area Network) cable, or the like through which information such as the printing data Img or the like is supplied from the host computer. Additionally, the output terminal Tn2 is a terminal for connecting to an internal wiring 220 for supplying various kinds of control signals such as the printing signal SI, the driving signal Com, and the like generated in the control module 2 to various kinds of constituent elements such as the head unit HU, the transport mechanism 7, or the like. Note that, in the following descriptions, a circuit provided on the surface G2 of the substrate 200 may be referred to as a "second circuit". Additionally, in the following descriptions, the first circuit and the second circuit provided on the substrate 200 may be referred to as a "driving circuit".

Note that, the substrate 200 is provided with a screw hole HL for inserting a screw SC. In the embodiment, as exemplified in FIG. 7 and FIG. 8, a case where the screw hole HL is provided between the transistors Tr1 and Tr2 is assumed as an example.

Figure 9:
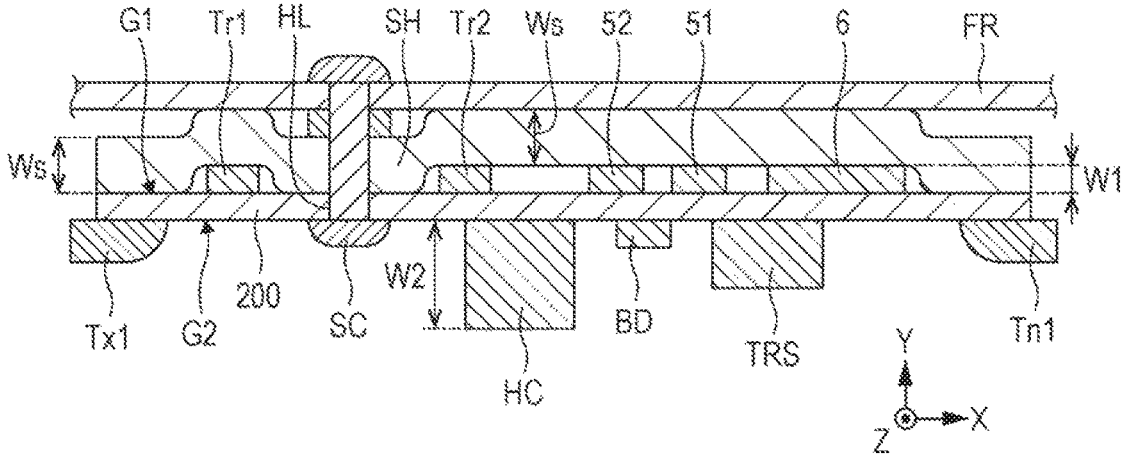
FIG. 9 is a descriptive diagram for explaining an example of a positional relationship between the substrate and a heat conductive sheet.
Figure 10:
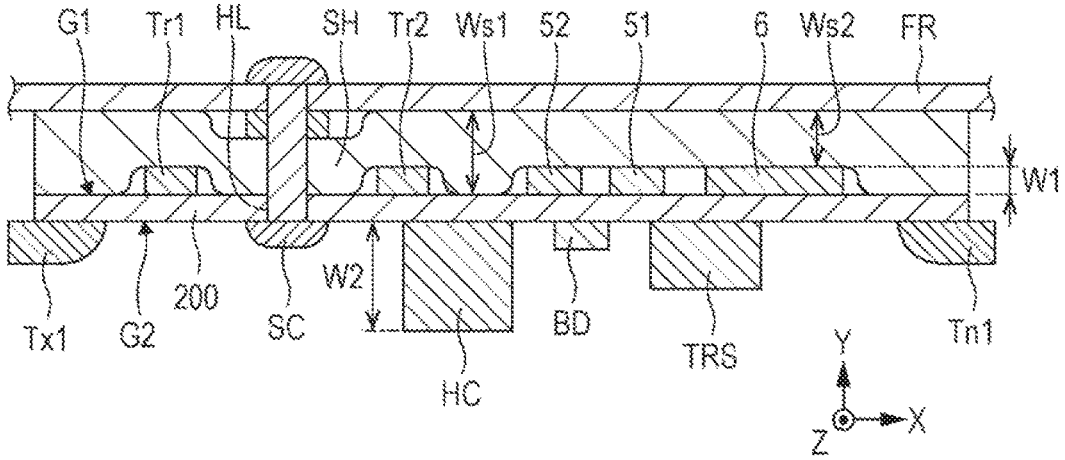
FIG. 10 is a descriptive diagram for explaining an example of a positional relationship between the substrate and the heat conductive sheet.

FIG. 9 is an example of a partial cross-sectional view obtained by dividing the ink jet printer 1 at a plane along a IX-IX line in FIG. 7 and FIG. 8.

As exemplified in FIG. 9, the heat conductive sheet SH is provided, between the surface G1 of the substrate 200 and the frame FR, so as to at least make contact with the surface G1 of the substrate 200, the transistors Tr1 and Tr2, and the frame FR.

In the following, as exemplified in FIG. 9, a distance between a portion of the first circuit farthest from the surface G1 and the surface G1 is referred to as a "distance W1". Furthermore, in the following, a distance between a portion of the second circuit farthest from the surface G2 and the surface G2 is referred to as a "distance W2". Additionally, in the embodiment, the first circuit and the second circuit are provided such that the distance W1 is shorter than the distance W2. In other words, in the embodiment, of various kinds of circuits included in the control module 2, a circuit having a constituent element whose height from the substrate 200 is high, such as the smoothing capacitor HC or the like, is provided on the surface G2. Additionally, in the embodiment, of various kinds of circuits included in the control module 2, only constituent elements whose height from the substrate 200 are no more than the distance W1, such as the transistors Tr1 and Tr2, are provided on the surface G1. Therefore, in the embodiment, in comparison with a case where the height of the first circuit provided on the surface G1 is higher than the distance W1, close adhesion between the heat conductive sheet SH and the surface G1 can be enhanced. Note that, in the embodiment, a width Ws of the heat conductive sheet SH is preferably no less than the distance W1, and more preferably no less than 1.5 times the distance W1. Additionally, in the embodiment, the width Ws of the heat conductive sheet SH may be no less than the distance W1 and no more than the distance W2.

Additionally, in the embodiment, as exemplified in FIG. 9, using the screw SC for fixing the substrate 200 to the frame FR, the heat conductive sheet SH is fixed to the frame FR. In other words, in the embodiment, the substrate 200 and the heat conductive sheet SH are fixed to the frame FR using the same screw.

Note that, in FIG. 9, although a case where the heat conductive sheet SH has the width Ws that is constant in a thickness direction is illustrated as an example, the invention is not limited to such an aspect, the heat conductive sheet SH may be formed of an elastic material and a width of the heat conductive sheet SH in the thickness direction may be variable. In this case, as exemplified in FIG. 10, the heat conductive sheet SH may have a width Ws1 and make contact with the surface G1 at a portion of the surface G1 not provided with the first circuit, and may have a width Ws2 and make contact with the first circuit at a portion of the surface G1 provided with the first circuit. Here, the width Ws1 satisfies at least "W1<Ws1", and the width Ws2 satisfies at least "0<Ws2<Ws1".

6. Overview of Head Unit

Hereinafter, referring to FIG. 11 to FIG. 13, a configuration and an operation of the head unit HU will be described.

Figure 11:
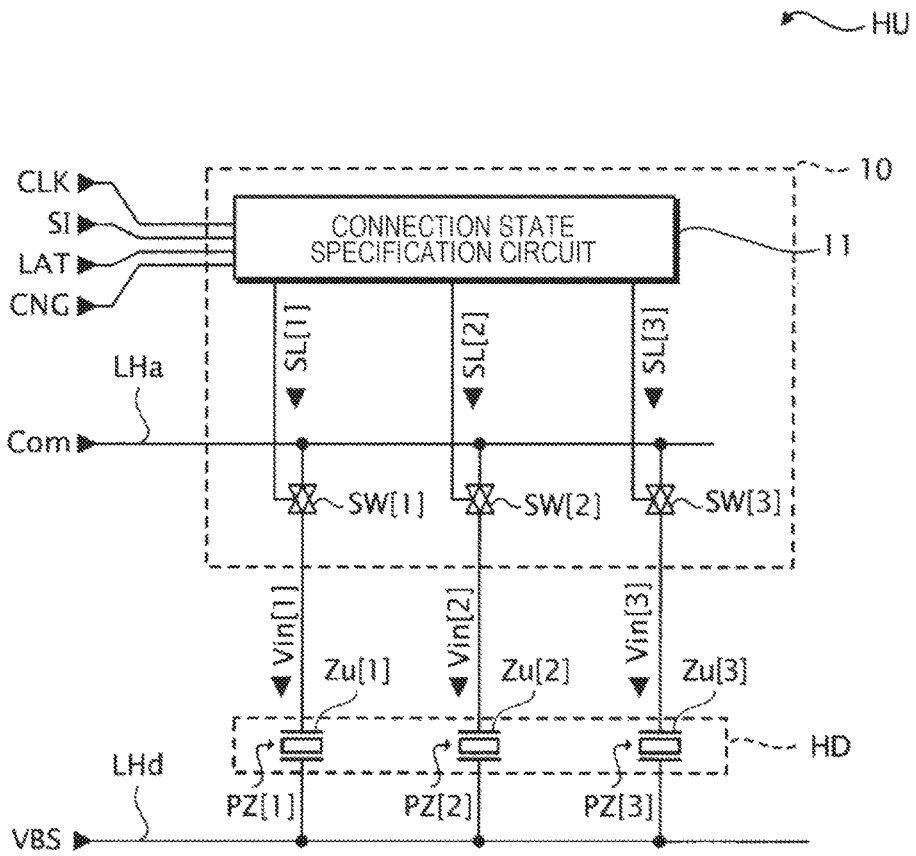
FIG. 11 is a block diagram illustrating an example of a configuration of a head unit.

FIG. 11 is a block diagram illustrating an example of the configuration of the head unit HU. As described above, the head unit HU includes the recording head HD, the supply circuit 10, the wiring LHa, and the power feed line LHd.

The supply circuit 10 includes 4M switches SW (SW[1] to SW[4M]) and a connection state specification circuit 11 that specifies a connection state of each of the switches SW. Note that, as each of the switches SW, for example, a transmission gate can be employed. Note that, FIG. 11 illustrates only three switches SW for the sake of simplicity.

The connection state specification circuit 11 generates, on the basis of at least a part of signals of a clock signal CLK, the printing signal SI, a latch signal LAT, and a change signal CNG supplied from the control circuit 6, connection state specification signals SL[1] to SL[4M] that specify the switches SW[1] to SW[4M] being turned on and off, respectively. The switch SW[m] switches conduction and non-conduction between the wiring LHa and the upper electrode Zu[m] of the piezoelectric element PZ[m] provided in the discharge section D[m] in accordance with the connection state specification signal SL[m]. For example, the switch SW[m] is turned on in a case where the connection state specification signal SL[m] is at a high level, and turned off in a case of a low level. As described above, a signal, in the driving signal Com, actually supplied to the piezoelectric element PZ[m] of the discharge section D[m] through the switch SW[m] is the supply driving signal Vin[m].

In the embodiment, an operation period of the ink jet printer 1 includes one or a plurality of unit periods Tu. The ink jet printer 1 can drive each of the discharge sections D for the printing processing in each of the unit periods Tu. Additionally, by executing the printing processing in the plurality of unit periods Tu that are continuously or intermittently provided, the ink jet printer 1 causes each of the discharge sections D to discharge the ink once or a plurality of times, for example, and forms an image indicated by the printing data Img.

Figures 12, 13:
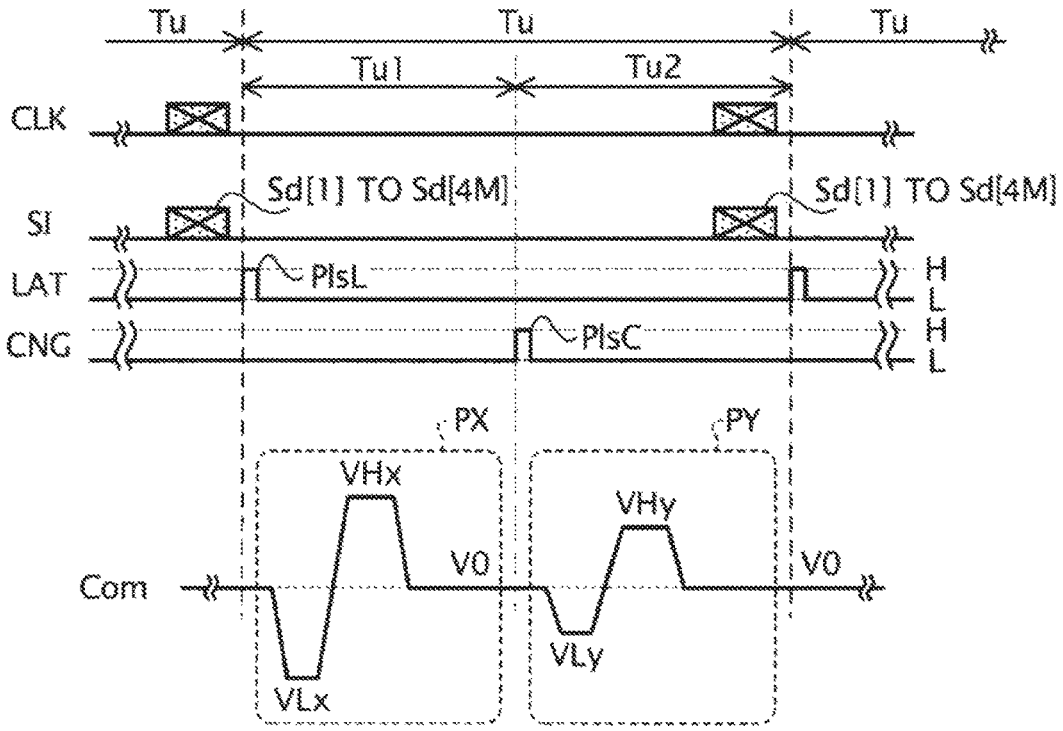
FIG. 12 is a timing chart for explaining an example of an operation in printing processing.
FIG. 13 is a descriptive diagram for explaining an example of a connection state specification signal.

FIG. 12 is a timing chart illustrating an example of the operation of the ink jet printer 1 in the unit period Tu.

As illustrated in FIG. 12, the control circuit 6 outputs the latch signal LAT having a pulse PlsL. With this, the control circuit 6 defines the unit period Tu as a period from a rise of the pulse PlsL to a next rise of the pulse PlsL. Additionally, the control circuit 6 outputs the change signal CNG having a pulse PlsC. With this, the control circuit 6 divides the unit period Tu into a control period Tu1 from the rise of the pulse PlsL to a rise of the pulse PlsC and a control period Tu2 from the rise of the pulse PlsC to the next rise of the pulse PlsL.

Additionally, the printing signal SI includes individual specification signals Sd[1] to Sd[4M] that specify types of operations of the discharge sections D[1] to D[4M] in each of the unit periods Tu. Additionally, in a case where the printing processing is executed in the unit period Tu, the control circuit 6 supplies the printing signal SI including the individual specification signals Sd[1] to Sd[4M] to the connection state specification circuit 11 in synchronization with the clock signal CLK prior to the unit period Tu. In this case, the connection state specification circuit 11 generates, in the unit period Tu, the connection state specification signal SL[m] on the basis of the individual specification signal Sd[m].

As illustrated in FIG. 12, the driving signal Com has a waveform PX provided in the control period Tu1 and a waveform PY provided in the control period Tu2. In the embodiment, the waveform PX and the waveform PY are determined such that a potential difference between the maximum potential VHX and the minimum potential VLX of the waveform PX becomes larger than a potential difference between the maximum potential VHY and the minimum potential VLY of the waveform PY. Specifically, in a case where the discharge section D[m] is driven by the driving signal Com having the waveform PX, the waveform of the waveform PX is determined such that the ink in an amount corresponding to a medium dot (medium amount) is discharged from the discharge section D[m]. Additionally, in a case where the discharge section D[m] is driven by the driving signal Com having the waveform PY, the waveform of the waveform PY is determined such that the ink in an amount corresponding to a small dot (small amount) is discharged from the discharge section D[m]. Note that, in the waveform PX and the waveform PY, potentials at starting and ending are each set to a reference potential V0.

FIG. 13 is a descriptive diagram for explaining a relationship between the individual specification signal Sd[m] and the connection state specification signal SL[m].

As illustrated in FIG. 13, in the embodiment, a case where the individual specification signal Sd[m] is a two-bit digital signal is assumed. Specifically, the individual specification signal Sd[m] is, in each of the unit periods Tu, with respect to the discharge section D[m], set to any one value among four values of a value (1, 1) for specifying to discharge the ink in an amount corresponding to a large dot (large amount) (referred to as "large dot formation" in some cases), a value (1, 0) for specifying to discharge the medium amount of ink (referred to as "medium dot formation" in some cases), a value (0, 1) for specifying to discharge the small amount of ink (referred to as "small dot formation" in some cases), and a value (0, 0) for specifying not to discharge the ink.

In a case where the individual specification signal Sd[m] is set to the value (1, 1) for specifying the large dot formation, the connection state specification circuit 11 sets the connection state specification signal SL[m] to a high level in the control periods Tu1 and Tu2. In this case, the discharge section D[m] is driven, in the control period Tu1, by the driving signal Com with the waveform PX and discharges the medium amount of ink, and is driven, in the control period Tu2, by the driving signal Com with the waveform PY and discharges the small amount of ink. With this, the discharge section D[m] discharges, in the unit period Tu, the large amount of ink in total, and the large dot is formed on the recording paper P.

In a case where the individual specification signal Sd[m] is set to the value (1, 0) for specifying the medium dot formation, the connection state specification circuit 11 sets the connection state specification signal SL[m] to the high level in the control period Tu1 and to a low level in the control period Tu2. In this case, the discharge section D[m] discharges, in the unit period Tu, the medium amount of ink, and the medium dot is formed on the recording paper P.

In a case where the individual specification signal Sd[m] is set to the value (0, 1) for specifying the small dot formation, the connection state specification circuit 11 sets the connection state specification signal SL[m] to the low level in the control period Tu1 and to the high level in the control period Tu2. In this case, the discharge section D[m] discharges, in the unit period Tu, the small amount of ink, and the small dot is formed on the recording paper P.

In a case where the individual specification signal Sd[m] is set to the value (0, 0) for specifying not to discharge the ink, the connection state specification circuit 11 sets the connection state specification signal SL[m] to the low level in the control periods Tu1 and Tu2. In this case, the discharge section D[m] does not discharge the ink in the unit period Tu, and the dot is not formed on the recording paper P.

7. Conclusion of Embodiment

As described above, in the embodiment, the heat conductive sheet SH is provided so as to make contact with the surface G1 of the substrate 200, the transistors Tr1 and Tr2, and the frame FR. Therefore, according to the embodiment, the heat generated in the driving signal generation circuit 5, particularly, the heat generated in the transistors Tr1 and Tr2 can be dissipated outside the ink jet printer 1 through the heat conductive sheet SH and the frame FR.

Additionally, in the embodiment, as the heat dissipation mechanism for the dissipation of the heat of the substrate 200, the heat conductive sheet SH that is the flat sheet-shaped member having the elasticity is employed. Therefore, according to the embodiment, for example, in comparison with a case where a heat sink, a cooling fan, or the like is employed as the heat dissipation mechanism, a space in the housing 100 to be secured for providing the heat dissipation mechanism can be reduced. With this, according to the embodiment, in comparison with a case where the heat sink, the cooling fan, or the like is employed as the heat dissipation mechanism, the ink jet printer 1 is reduced in size with ease.

Additionally, in the embodiment, the height of the first circuit provided on the surface G1 from the surface G1 is made lower than the height of the second circuit provided on the surface G2 from the surface G2. Therefore, according to the embodiment, for example, in comparison with a case where the height of the first circuit provided on the surface G1 is higher than the height of the second circuit provided on the surface G2, the close adhesion between the heat conductive sheet SH and the surface G1 can be enhanced. With this, according to the embodiment, the heat of the substrate 200 can be efficiently dissipated through the heat conductive sheet SH.

B. Variation

Each mode described above may be variously modified. Specific modification aspects will be described below as an example. Two or more aspects arbitrarily selected from examples described below may appropriately be combined in a range in which they are not inconsistent with each other. Note that, in variations described below as an example, elements having the same actions and functions as the embodiment are given the reference numerals used in the above description, and detailed descriptions thereof will be appropriately omitted.

First Variation

Although, in the embodiment described above, M is described as being a natural number of one or more, M may be a natural number of 180 or more. In other words, 720 or more discharge sections D may be provided in the recording head HD. In this case, the 720 or more discharge sections D provided in the recording head HD may be driven by the driving signal Com generated by the driving signal generation circuit 5.

Second Variation

Although, in the embodiment and the variation described above, in the ink jet printer 1, the one heat conductive sheet SH is provided as the heat dissipation mechanism for dissipating the heat in the substrate 200, the invention is not limited to such an aspect, two or more heat conductive sheets SH may be provided as the heat dissipation mechanism. For example, the ink jet printer 1 may include one heat conductive sheet SH that makes contact with the surface G1 of the substrate 200, the first circuit, and the frame FR, and another heat conductive sheet SH that makes contact with the surface G2 of the substrate 200, the second circuit, and the frame FR.

Third Variation

Although, in the embodiment and the variations described above, the one screw hole HL is provided between the transistors Tr1 and Tr2, the invention is not limited to such an aspect, a plurality of screw holes HL may be provided between the transistors Tr1 and Tr2.

Fourth Variation

Although, in the embodiment and the variations described above, the ink jet printer 1 includes the one driving signal generation circuit 5 and the one head unit HU, the invention is not limited to such an aspect, the ink jet printer 1 may include a plurality of the driving signal generation circuits 5 and may include a plurality of the head units HU.

For example, the ink jet printer 1 may drive, by selectively supplying a plurality of the driving signals Com that have different waveforms from one another to each of the discharge sections D included in the head unit HU, the discharge section D. In this case, on the substrate 200, the plurality of driving signal generation circuits 5 may be provided so as to correspond to the plurality of driving signals Com on one-to-one basis.

Additionally, for example, the ink jet printer 1 may include the plurality of head units HU. In this case, on the substrate 200, the plurality of driving signal generation circuits 5 may be provided so as to correspond to the plurality of head units HU on one-to-one basis.

Additionally, in the variation, in a case where the plurality of driving signal generation circuits 5 are provided on the substrate 200, the heat conductive sheet SH is provided so as to make contact with the transistors Tr1 and Tr2 included in each of the driving signal generation circuits 5.

Fifth Variation

Although, in the embodiment and the variations described above, a case where the ink jet printer 1 is a serial printer is assumed, the invention is not limited to such an aspect, the ink jet printer 1 may be a so-called line printer in which, in the recording head HD, the plurality of nozzles N are provided so as to extend wider than a width of the recording paper P.

What is claimed is:

1. A liquid discharge apparatus comprising:

a frame;

a substrate that is fixed to the frame and has a first surface and a second surface;

a first circuit that is provided on the first surface;

a second circuit that is provided on the second surface;

a heat conductive sheet; and a head unit that is driven by a driving signal and is capable of discharging liquid, wherein the first circuit includes a driving signal generation circuit that generates the driving signal using a first transistor and a second transistor, the heat conductive sheet is in contact with the frame, the first surface, the first transistor, and the second transistor, and a distance between a portion of the first circuit farthest from the first surface and the first surface is shorter than a distance between a portion of the second circuit farthest from the second surface and the second surface.

2. The liquid discharge apparatus according to claim 1, wherein the first circuit includes a waveform specification circuit that generates a waveform specification signal configured to specify a waveform of the driving signal, and the first transistor and the second transistor generate the driving signal having a waveform specified by the waveform specification signal.

3. The liquid discharge apparatus according to claim 1, wherein the first transistor and the second transistor each are a bipolar transistor.

4. The liquid discharge apparatus according to claim 1, wherein the second circuit includes a power source circuit that supplies a power source to the driving signal generation circuit, and the power source circuit includes a smoothing capacitor to which an AC voltage is inputted and that smooths the AC voltage.

5. The liquid discharge apparatus according to claim 1, wherein a thickness of the heat conductive sheet is no less than the distance between the portion of the first circuit farthest from the first surface and the first surface.

6. The liquid discharge apparatus according to claim 1, wherein the heat conductive sheet has elasticity.

7. The liquid discharge apparatus according to claim 1, including a screw for fixing the substrate to the frame, wherein the heat conductive sheet is fixed to the frame with the screw.

8. The liquid discharge apparatus according to claim 1, wherein the head unit includes 720 or more discharge sections, and the discharge sections are driven by the driving signal and capable of discharging the liquid.

9. A driving circuit provided in a liquid discharge apparatus that includes:

a frame;

a substrate that is fixed to the frame and has a first surface and a second surface;

a heat conductive sheet; and a head unit that is driven by a driving signal and is capable of discharging liquid, the driving circuit comprising:

a first circuit that is provided on the first surface; and a second circuit that is provided on the second surface, wherein the first circuit includes a driving signal generation circuit that generates the driving signal using a first transistor and a second transistor, the heat conductive sheet is in contact with the frame, the first surface, the first transistor, and the second transistor, and a distance between a portion of the first circuit farthest from the first surface and the first surface is shorter than a distance between a portion of the second circuit farthest from the second surface and the second surface.

* * * * *